US011658423B2

(12) United States Patent
Herrero et al.

(10) Patent No.: US 11,658,423 B2
(45) Date of Patent: May 23, 2023

(54) MULTIBEAM ANTENNA COMPRISING DIRECT RADIATING ARRAY AND REFLECTOR

(71) Applicant: Airbus Defence and Space Limited, Stevenage (GB)

(72) Inventors: Carolina Tienda Herrero, Stevenage (GB); Simon Stirland, Stevenage (GB)

(73) Assignee: Airbus Defence and Space Limited, Stevenage (GB)

( * ) Notice: Subject to any disclaimer, the term of this patent is extended or adjusted under 35 U.S.C. 154(b) by 0 days.

(21) Appl. No.: 17/767,514

(22) PCT Filed: Oct. 8, 2020

(86) PCT No.: PCT/GB2020/052495

§ 371 (c)(1),
(2) Date: Apr. 8, 2022

(87) PCT Pub. No.: WO2021/069900

PCT Pub. Date: Apr. 15, 2021

(65) Prior Publication Data

US 2022/0399652 A1 Dec. 15, 2022

(30) Foreign Application Priority Data

Oct. 9, 2019 (EP) ..... 19202251

(51) Int. Cl.
*H01Q 15/14* (2006.01)
*H01Q 1/28* (2006.01)
(Continued)

(52) U.S. Cl.
CPC ..... *H01Q 15/147* (2013.01); *H01Q 1/288* (2013.01); *H01Q 3/46* (2013.01); *H01Q 15/148* (2013.01); *H01Q 19/17* (2013.01)

(58) Field of Classification Search
CPC ..... H01Q 1/288; H01Q 3/46; H01Q 15/147–148; H01Q 19/17
See application file for complete search history.

(56) References Cited

U.S. PATENT DOCUMENTS 4,439,773 A * 3/1984 Chu ..... H01Q 25/001 343/781 P
5,736,963 A * 4/1998 Roederer ..... H01Q 25/007 342/373
2016/0372835 A1* 12/2016 Toso ..... H01Q 19/192

FOREIGN PATENT DOCUMENTS

JP 2004-349886 A 12/2004
WO WO 2018/190794 A1 10/2018

OTHER PUBLICATIONS

Dec. 8, 2020 Search Report issued in International Patent Application No. PCT/GB2020/052495; 4 pp.
(Continued)

*Primary Examiner* — Andrea Lindgren Baltzell
*Assistant Examiner* — Amal Patel
(74) *Attorney, Agent, or Firm* — Nelson Mullins Riley & Scarborough LLP

(57) ABSTRACT

A multibeam antenna comprises a direct radiating array (DRA) comprising a plurality of radiating elements, a reflector facing the DRA so as to reflect a field generated by the DRA, and a DRA controller configured to control the plurality of radiating elements of the DRA according to a plurality of coefficients, such that the field generated at the DRA produces a plurality of beams when reflected by the reflector. The DRA controller is configured to determine the plurality of coefficients by using a bifocal antenna model to determine a field that would be produced by a subreflector and feed horn arrangement in an equivalent bifocal antenna configured to produce the plurality of beams, and determine the plurality of coefficients required to produce a similar
(Continued)

incident field at the surface of the reflector. A method of controlling the multibeam antenna, and corresponding computer program instructions, are also disclosed.

15 Claims, 5 Drawing Sheets

(51) Int. Cl.
*H01Q 3/46* (2006.01)
*H01Q 19/17* (2006.01)

(56) References Cited

OTHER PUBLICATIONS

Dec. 8, 2020 Written Opinion of the International Searching Authority issued in International Patent Application No. PCT/GB2020/052495; 6 pp.
Lukasz A Greda et al; "Beamfonning Capabilities of Array-Fed Reflector Antennas;" Apr. 11, 2011; XP031877823; IEEE Proceedings of the 5th European Conference on Antennas and Propagation (EUCAP); ISBN: 978-1-4577-0250-1; pp. 2852-2856; figures 1, 2.

* cited by examiner

MULTIBEAM ANTENNA COMPRISING DIRECT RADIATING ARRAY AND REFLECTOR

CROSS-REFERENCE TO RELATED APPLICATIONS

This application claims priority to and is a 35 U.S.C. § 371 U.S. National Stage Application of International Application No. PCT/GB2020/052495, entitled "MULTIBEAM ANTENNA COMPRISING DIRECT RADIATING ARRAY AND REFLECTOR", filed Oct. 8, 2020, which claims priority to European Application No. 19202251.5, entitled "MULTIBEAM ANTENNA COMPRISING DIRECT RADIATING ARRAY AND REFLECTOR", filed Oct. 9, 2019, the contents of each being incorporated by reference herein it is entirety.

TECHNICAL FIELD

The present invention relates to a multibeam antenna, a control method thereof, and computer program instructions for performing the method. In particular, the present invention relates to a multibeam antenna comprising a direct radiating array.

BACKGROUND

In a bifocal antenna, dual offset parabolic reflectors are arranged so as to give two foci in the vertical plane and two foci in the horizontal plane. The two reflectors, which can be referred to as a subreflector and a main reflector, can be designed using a suitable three-dimensional (3D) ray tracing algorithm that fulfils the reflection and path length conditions to produce a non-degraded set of beams defined within a certain scanning range. However, drawbacks of such antennas include their high cost due to the use of two parabolic reflectors, and the limitation in separation of the beams that can be achieved due to the need to physically accommodate the feed horns.

Accordingly, a variant on the bifocal antenna design has been proposed in which the parabolic subreflector and main reflector are replaced with two flat passive reflective arrays, which may also be referred to as 'reflectarrays'. However, in both the parabolic reflector and the reflectarray-based variants, the field of view of the antenna can be partially blocked by the feed horns that are used to illuminate the subreflector, resulting in a limited scanning range.

The invention is made in this context.

SUMMARY OF THE INVENTION

According to a first aspect of the present invention, there is provided a multibeam antenna comprising a direct radiating array (DRA) comprising a plurality of radiating elements, a reflector facing the DRA so as to reflect a field generated by the DRA, and a DRA controller configured to control the plurality of radiating elements of the DRA according to a plurality of coefficients, such that the field generated at the DRA produces a plurality of beams when reflected by the reflector, wherein the DRA controller is configured to determine the plurality of coefficients by using a bifocal antenna model to determine a field that would be produced by a subreflector and feed horn arrangement in an equivalent bifocal antenna configured to produce the plurality of beams, and determining the plurality of coefficients required to produce a similar incident field at the surface of the reflector.

In some embodiments according to the first aspect, the DRA controller is configured to receive antenna configuration information relating to the plurality of beams to be produced, and to determine the plurality of coefficients in dependence on the received antenna configuration information.

In some embodiments according to the first aspect, the plurality of beams include one or more beams corresponding respectively to one or more intermediate focal points between a first focal point and a second focal point of the bifocal antenna model.

In some embodiments according to the first aspect, the DRA controller is configured to set up the bifocal antenna computer model based on the received antenna configuration information.

In some embodiments according to the first aspect, the DRA controller is configured to determine the plurality of coefficients by using the received antenna configuration information to retrieve the coefficients from memory arranged to store a plurality of sets of pre-calculated coefficients each associated with a different plurality of beams.

In some embodiments according to the first aspect, the reflector comprises a passive reflectarray. In other embodiments, the reflector may comprise an active reflectarray.

In some embodiments according to the first aspect, the active reflectarray is a flat reflectarray. In other embodiments, the active reflectarray may be curved.

In some embodiments according to the first aspect, the multibeam antenna comprises a reflectarray controller configured to control a plurality of reflecting elements of the reflectarray according to a plurality of reflectarray phase controls.

In some embodiments according to the first aspect, the reflectarray phase controller is configured to select the plurality of reflectarray phase controls so as to cancel one or more grating lobes in the field produced by the DRA.

According to a second aspect of the present invention, there is provided a method of controlling a multibeam antenna comprising a direct radiating array (DRA) comprising a plurality of radiating elements, and a reflector facing the DRA so as to reflect a field generated by the DRA, the method comprising: determining a plurality of coefficients for controlling the plurality of radiating elements of the DRA, by using a bifocal antenna model to determine a field that would be produced by a subreflector and feed horn arrangement in an equivalent bifocal antenna configured to produce a plurality of beams, and determining the plurality of coefficients required to produce a similar incident field at the surface of the reflector; and controlling the plurality of radiating elements of the DRA according to the determined plurality of coefficients, such that the field generated at the DRA produces the plurality of beams when reflected by the reflector.

In some embodiments according to the second aspect, the method comprises receiving antenna configuration information relating to the plurality of beams to be produced, and determining the plurality of coefficients in dependence on the received antenna configuration information.

In some embodiments according to the second aspect, the plurality of beams include one or more beams corresponding respectively to one or more intermediate focal points between a first focal point and a second focal point of the bifocal antenna model.

In some embodiments according to the second aspect, the method comprises setting up the bifocal antenna computer model based on the received antenna configuration information.

According to a third aspect of the present invention, there is provided a non-transitory computer-readable storage medium storing computer program instructions which, when executed, perform a method according to the second aspect.

BRIEF DESCRIPTION OF THE DRAWINGS

Embodiments of the present invention will now be described, by way of example only, with reference to the accompanying drawings, in which.

DETAILED DESCRIPTION

Figure 1:
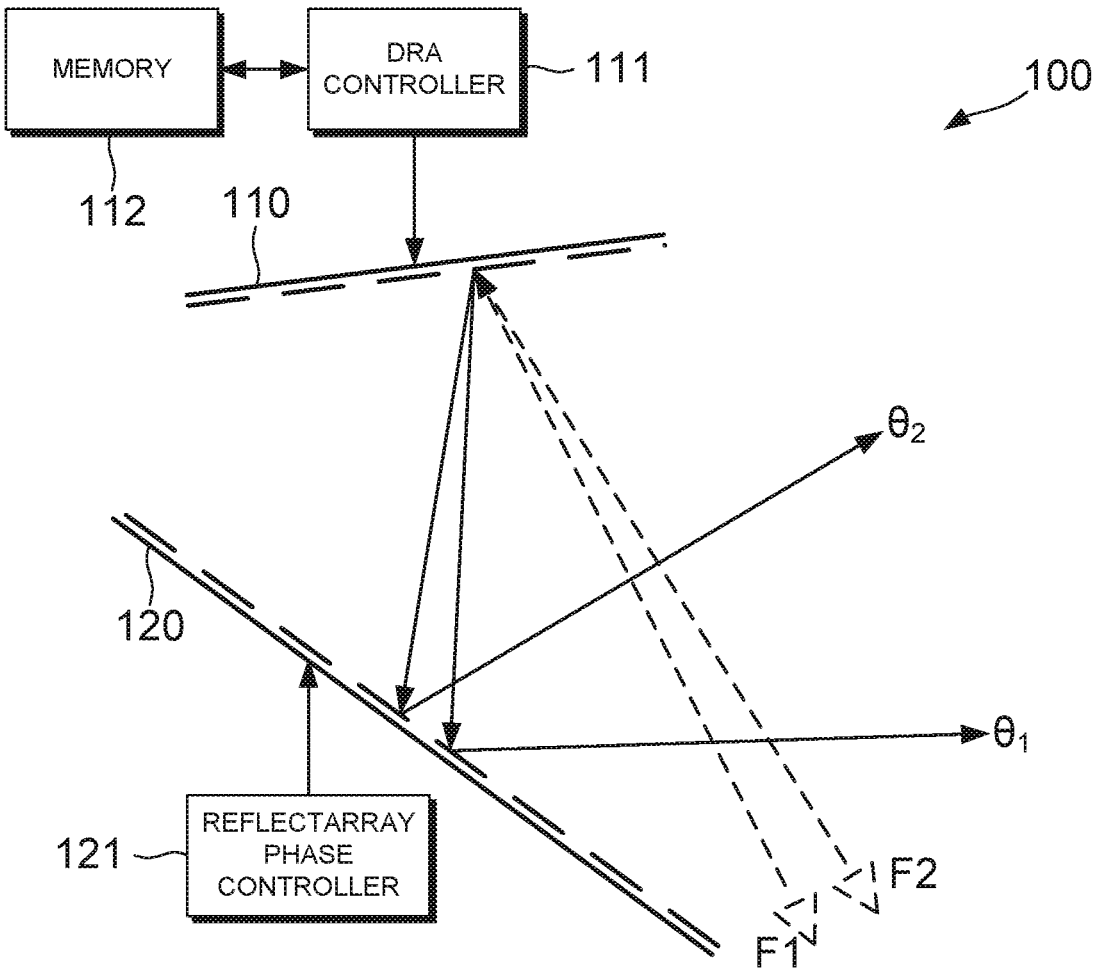
FIG. 1 illustrates a multibeam antenna comprising a direct radiating array (DRA) and an active reflectarray, according to an embodiment of the present invention.

In the following detailed description, only certain exemplary embodiments of the present invention have been shown and described, simply by way of illustration. As those skilled in the art would realise, the described embodiments may be modified in various different ways, all without departing from the scope of the present invention. Accordingly, the drawings and description are to be regarded as illustrative in nature and not restrictive. Like reference numerals designate like elements throughout the specification.

Figure 2:
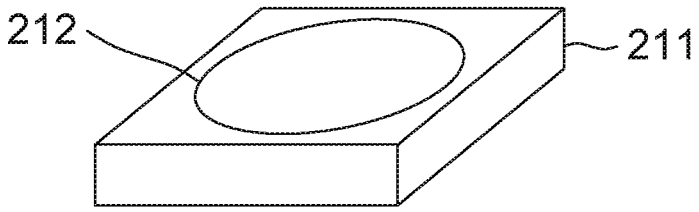
FIG. 2 illustrates a radiating element of a DRA, according to an embodiment of the present invention.

Referring now to FIGS. 1 and 2, a multibeam antenna comprising a direct radiating array (DRA) is illustrated according to an embodiment of the present invention. As shown in FIG. 1, the antenna wo comprises a DRA 110, a reflectarray 120, and a DRA controller 111. The DRA no comprises a plurality of independently controllable radiating elements which can be controlled by the DRA controller 111 to generate a desired incident field at the surface of the reflectarray 120. The reflectarray 120 is disposed facing the DRA no so as to reflect the field that is generated by the DRA 110. An antenna 100 such as the one shown in FIG. 1 may be included in a satellite, for example a communications satellite. Although in the present embodiment a reflectarray 120 is used, in other embodiments the antenna 100 could comprise any suitable form of reflector in place of the reflectarray 120, for example a parabolic reflector.

A radiating element of the DRA no according to an embodiment of the present invention is illustrated in FIG. 2. In the present embodiment each radiating element comprises a circular patch 212 of electrically conductive material, for example a layer of metallisation, on a dielectric substrate 211. The circular patch 212 generates linearly polarized electromagnetic radiation. In other embodiments the patch 212 may have a different shape, in other words, the radiating element may comprise a non-circular patch. In some embodiments the patch 212 may be configured to generate circularly polarized electromagnetic radiation. The DRA controller 111 can generate an arbitrary field at the surface of the DRA no by applying signals with suitable phase and amplitude relationships to the patches 212 of the plurality of radiating elements. The relative phase and amplitude for each patch 212 is determined by a corresponding coefficient.

In the present embodiment the DRA no is configured to operate in the 19.7 Gigahertz (GHz) frequency band, and comprises an array of 131×123 elements with a periodicity of 10 millimetres (mm)×10 mm. The periodicity may also be referred to as the cell size. Each radiating element comprises a circular patch of 5 mm diameter on a substrate with a dielectric constant of 3.18. However, it will be appreciated that these parameters are described merely by way in example, and in other embodiments different types of DRA no may be used.

The multibeam antenna 100 of the present embodiment differs from a conventional bifocal antenna in that the reflectarray 120 of the antenna 100 is illuminated by a field produced directly by the DRA 110, as opposed to being illuminated by beams emitted from a plurality of feed horns and reflected off a subreflector. In other words, in embodiments of the present invention the DRA no replaces the feed horns and subreflector of a conventional bifocal antenna. By removing the need for feed horns, an antenna 100 according to an embodiment of the present invention can generate a plurality of beams without suffering from the degradation of beams at the edge of the coverage that would otherwise occur as a result of blockage due to the feed horns.

The DRA controller 111 is configured to control the DRA 110 based on a plurality of coefficients, each of which corresponds to one of the independently controllable radiating elements in the DRA 110. By choosing a suitable set of coefficients to control the radiating elements, a field may be generated at the surface of the DRA 110 that will produce a plurality of beams when reflected by the reflectarray 120. The coefficients may be selected to as to produce a field at the surface of the DRA 110 that is equivalent to the field that would be produced by the subreflector and feed horns in a bifocal antenna. The set of coefficients may be determined by modelling a field that would be produced by the subreflector and feed horns in a hypothetical analogous bifocal antenna equivalent to the DRA-based antenna 100 of the present embodiment, and then determining the coefficients of the DRA that will produce a similar radiated field. In FIG. 1, dashed lines are used to indicate theoretical beam paths and feed horn positions at first and second focal points F1, F2 of a hypothetical analogous bifocal antenna.

Here, the equivalent bifocal antenna on which the model is based may be a dual offset bifocal reflector antenna. In other embodiments however, a different type of bifocal antenna may be used as the basis for modelling the incident field to be produced at the surface of the reflector, for example a single offset bifocal antenna. In the present embodiment a dual offset bifocal reflector antenna is chosen, as this form of bifocal antenna offers improved performance in comparison to a single offset bifocal antenna.

The antenna 100 can be controlled so as to change the beam pattern by changing the coefficients that are used to drive the plurality of radiating elements of the DRA 110, for example to change the number of beams and/or their directions. In the present embodiment a plurality of sets of pre-calculated coefficients each associated with a different plurality of beams are stored in memory 112. The DRA controller 111 is configured to retrieve the coefficients from the memory 112. In this way the computational burden on the DRA controller 111 can be reduced, since the DRA controller in does not need to calculate the coefficients from first principles each time the antenna 100 is reconfigured to produce a different beam pattern. Depending on the embodiment the memory 112 may be local memory included in the DRA controller in, or may be memory that is accessed remotely, for example by querying a remote server which provides the appropriate pre-calculated coefficients.

The reflectarray 120 can be flat or curved, and may be active or passive, depending on the embodiment. In the embodiment illustrated in FIG. 1 the reflectarray 120 comprises an active reflectarray 120 comprising a plurality of independently controllable reflecting elements, and the multibeam antenna 100 comprises a reflectarray phase controller 121 configured to control a plurality of reflecting elements of the reflectarray 120 according to a plurality of reflectarray phase controls. It will be appreciated that in embodiments in which a passive reflectarray is used, the reflectarray phase controller 121 is not required and so can be omitted.

The reflectarray 120 can be capable of providing a similar performance to a reflector but at a lower cost, with the added advantage of providing more degrees of freedom in the form of phases of the independently controllable reflecting elements, which can be used to further improve the performance of the antenna. In embodiments in which one or more grating lobes are present in the field produced by the DRA 110, the reflectarray phase controller 121 may be configured to select the plurality of reflectarray phase controls so as to wholly or partially cancel the grating lobes. The reflectarray 120 of the present embodiment is flat, thereby reducing the overall size of the antenna 100 in comparison to embodiments in which a curved reflector is used. However, in other embodiments a curved reflectarray 120 may be used, which can provide a higher bandwidth than a flat reflectarray.

Advantages of using an active or passive reflectarray, as opposed to a simple parabolic reflector, include but are not limited to: the ability to direct beams with orthogonal polarizations in different directions; the ability to convert the polarization direction of a particular beam from linear to circular, or vice versa; lower cost in comparison to a parabolic reflector; the ability to cancel crosspolarization which may arise due to the antenna geometry and/or the radiating elements of the DRA (and the elements of the reflectarray, if an active reflectarray is used); and the ability to change the coverage area of the antenna by reconfiguring the reflectarray.

By using a DRA no in combination with a suitable reflector, such as a reflectarray 120, and applying the principle of bifocal antennas, an antenna such as the one shown in FIG. 1 can produce a set of narrow beams without degradation of the beams at the edge of the coverage, relative to a conventional bifocal antenna in which degradation occurs as a result of the feeds located out of the focus of the parabola and blockage due to the feed horns, in case the geometry has blockage. Additionally, by using a DRA 110 instead of a parabolic subreflector and a feed horn array, the size of the antenna 100 can be reduced in comparison to conventional bifocal antennas. Furthermore, in some embodiments the coefficients for controlling the plurality of radiating elements of the DRA 110 may be selected so as to generate one or more intermediate beams in between the two beam directions $\theta_1$, $\theta_2$ illustrated in FIG. 1. Here, an 'intermediate beam' refers to a beam corresponding to an intermediate focal point between the first focal point F1 and the second focal point F2 of the equivalent bifocal antenna. An intermediate beam may be a beam that has an e-stable performance, or a non-degraded performance, at the corresponding intermediate focal point. In this way, an antenna 100 such as the one shown in FIG. 1 can provide greater configurability in terms of the range of beam patterns that may be produced, in comparison to a conventional bifocal antenna using a subreflector and feed horn array, since more intermediate beams can be produced.

The antenna 100 illustrated in FIG. 1 can be thought of as equivalent to a system with two foci in the vertical plane and another two foci in the horizontal one, which provides a 2D far field area with no degradation of the pattern. Since the DRA 110 is accommodated in a plane, the antenna 100 may be simpler to accommodate mechanically than alternative antenna designs in which a feed array is arranged along a curve.

The phases synthesized for the radiated field of the DRA 110 for an equivalent feed at the focal point F1 and an equivalent feed at the focal point F2 are shown in FIGS. 3 to 6. As described above, in the present embodiment the cell size for the DRA 110 is 10 mm×10 mm. The radiated fields illustrated in FIGS. 3 to 6 are computed based on the direction of radiation as $\theta3=28°$, $\varphi3=0°$. The bifocal antenna principle was applied so as not to degrade the beams within the antenna field of view, based on the design directions ($\theta1=25.6°$, $\varphi1=0°$) and ($\theta5=30.4°$, $\varphi5=0°$). FIG. 7 schematically illustrates the geometry of the system for which the radiated fields are illustrated in FIGS. 3 to 6, comprising a DRA 710, a DRA controller 711, and a passive reflectarray 720. All three beams illustrated in FIG. 7 lie in the plane of the drawing, and hence have the angle $\varphi$ equal to zero (i.e. $\varphi1=\varphi3=\varphi5=0°$).

Figure 3:
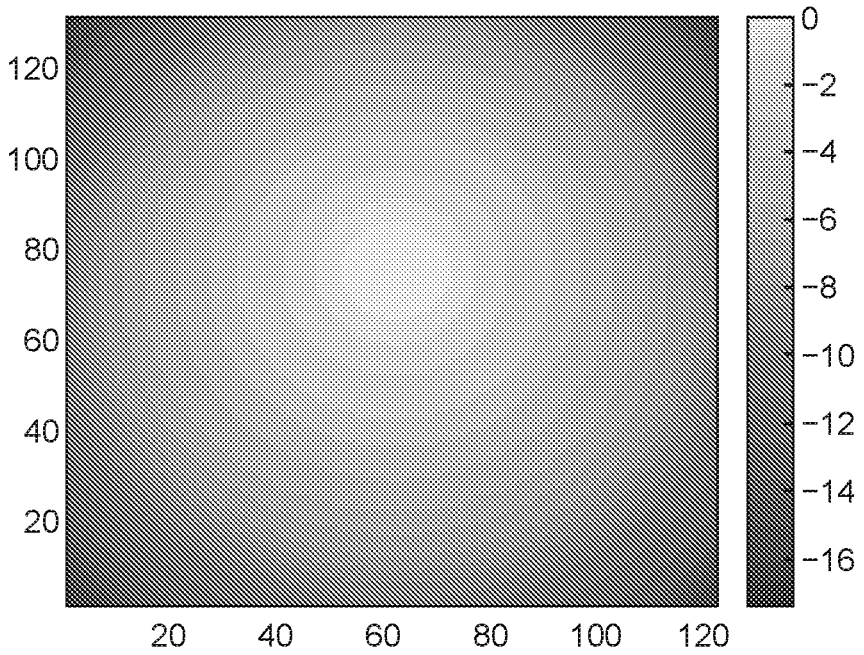
FIG. 3 illustrates the synthesized amplitude of the radiated field at the DRA for the first focal point F1 illustrated in FIG. 1, according to an embodiment of the present invention.
Figure 4:
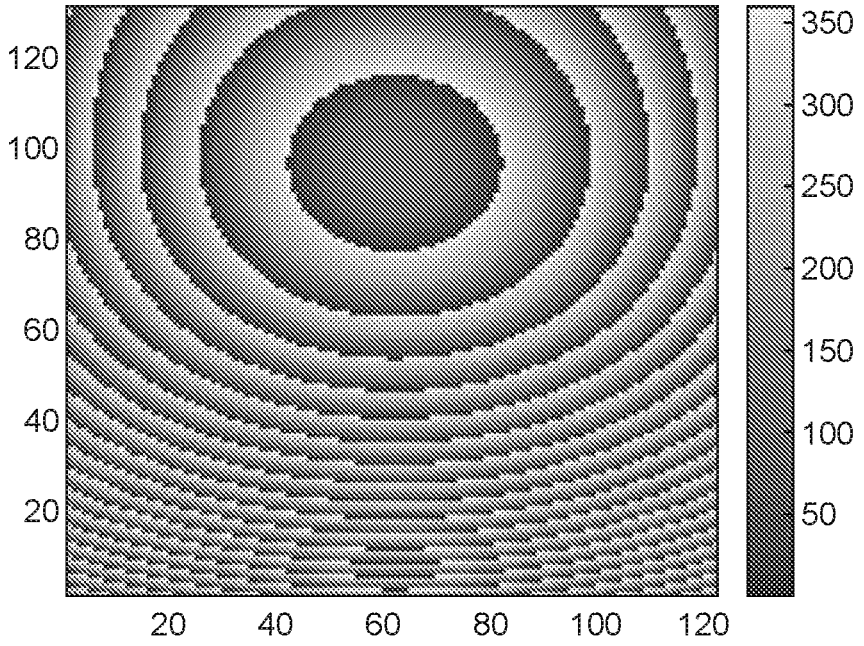
FIG. 4 illustrates the synthesized phase of the radiated field at the DRA for the first focal point F1 illustrated in FIG. 1, according to an embodiment of the present invention.
Figure 5:
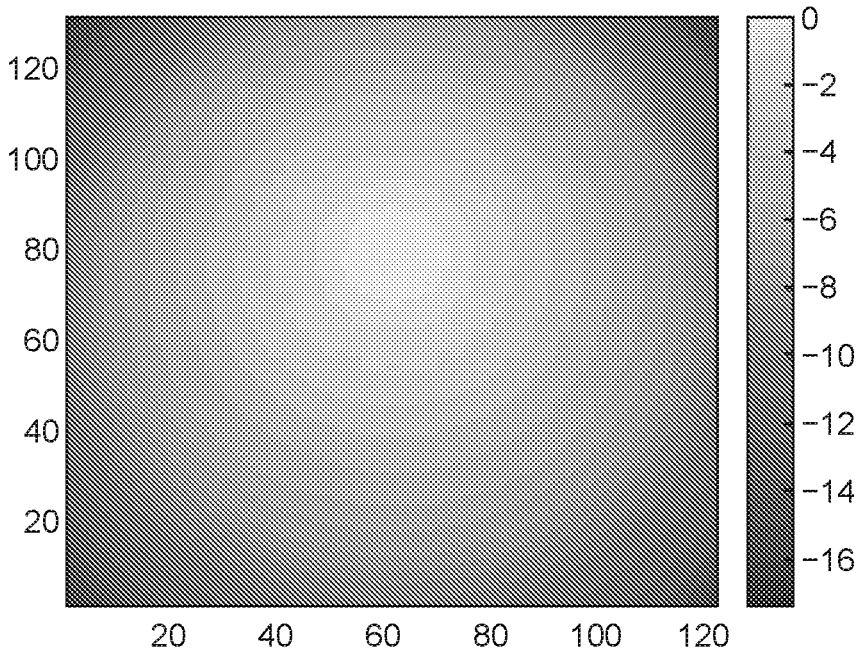
FIG. 5 illustrates the synthesized amplitude of the radiated field at the DRA for the second focal point F2 illustrated in FIG. 1, according to an embodiment of the present invention.
Figure 6:
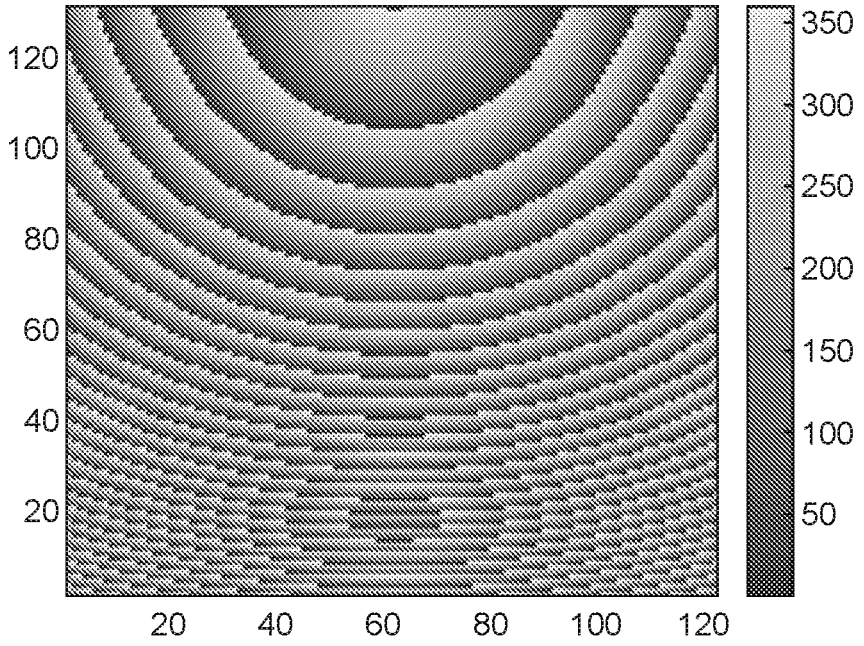
FIG. 6 illustrates the synthesized phase of the radiated field at the DRA for the second focal point F2 illustrated in FIG. 1, according to an embodiment of the present invention.
Figure 7:
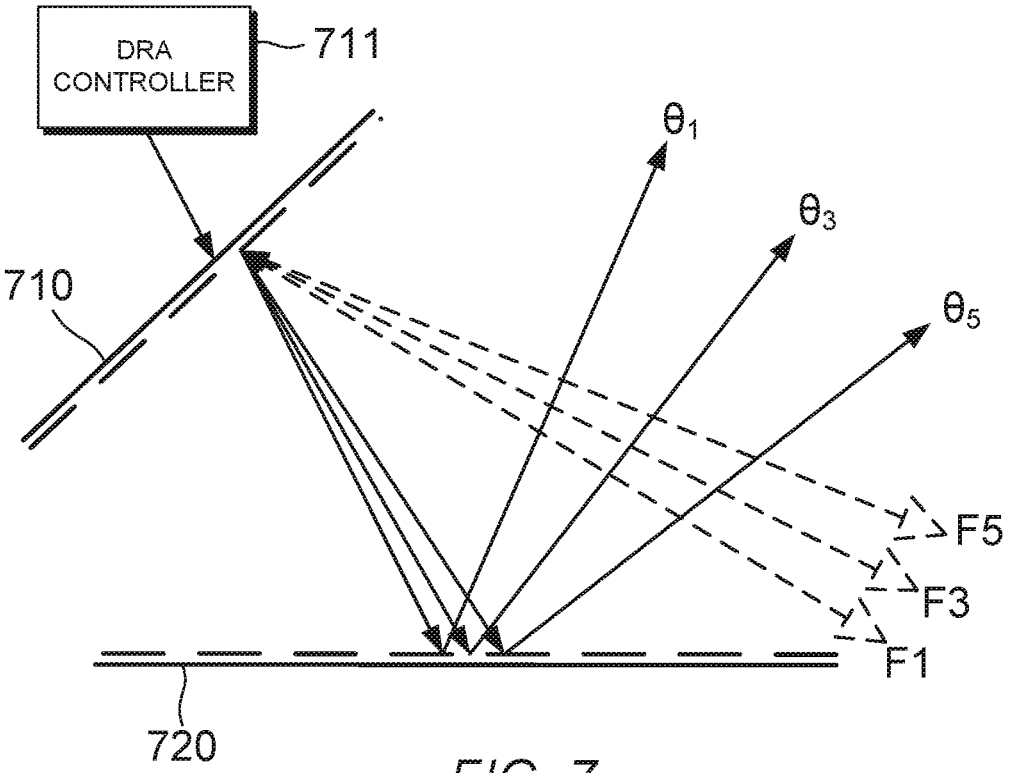
FIG. 7 illustrates a multibeam antenna comprising a DRA and a passive reflectarray, according to an embodiment of the present invention.
Figure 8:
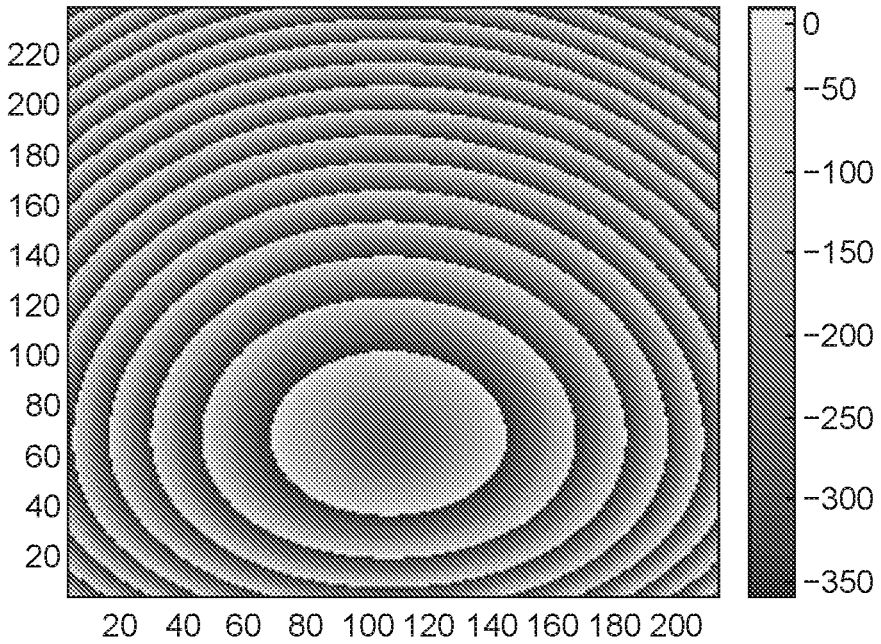
FIG. 8 illustrates the synthesized phases for the reflect array in the antenna illustrated in FIG. 1, according to an embodiment of the present invention.

The synthesized amplitude and phase of the radiated field at the DRA for the first focal point F1 are illustrated in FIGS. 3 and 4 respectively, whilst the synthesized amplitude and phase of the radiated field at the DRA for the second focal point F2 are illustrated in FIGS. 5 and 6 respectively. FIG. 8 illustrates the synthesized phases for the reflect array 120 in the antenna 100 of FIG. 1.

Figure 9:
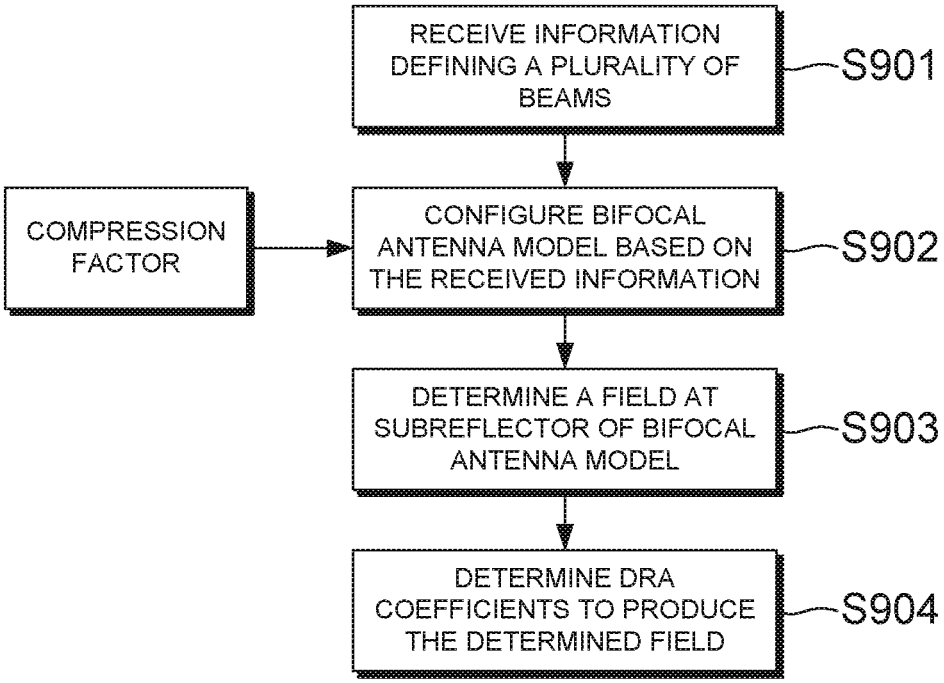
FIG. 9 is a flowchart illustrating a method of determining suitable DRA coefficients for producing a certain set of beams, according to an embodiment of the present invention.

Referring now to FIG. 9, a flowchart is illustrated showing a method of determining suitable DRA coefficients for producing a certain set of beams, according to an embodiment of the present invention. The method may be used by the DRA controller 111 of FIG. 1 or by the DRA controller 711 of FIG. 7. Alternatively, the method may be performed offline to pre-calculate sets of DRA coefficients associated with different beam configurations, and then stored in memory 112 for later retrieval by the DRA controller 111, 711. A method such as the one shown in FIG. 9 may be implemented in software by providing suitable computer program instructions stored on a non-transitory computer-readable storage medium, for example the memory 112 or any other suitable form of storage medium.

First, in step S901 antenna configuration information relating to the desired beam configuration is provided. For example, in step S901 the antenna configuration information may be provided in the form of input parameters specified by an operator. Depending on the embodiment, the antenna configuration could be a unique identifier associated with one of a plurality of predefined beam configurations. Alternatively, the antenna configuration information may explicitly define each one of the plurality of beams, for example by specifying a beam angle and/or coordinates of a focal point associated with the beam. In an embodiment in which the antenna 100 shown in FIG. 1 or 7 is included in a satellite, the DRA controller 111, 711 onboard the satellite may receive the antenna configuration information in step S901 in the form of signalling transmitted by a control station.

Then, in step S902 a bifocal antenna computer model is set up based on the received antenna configuration information. Setting up the model in step S902 may involve selecting a compact dual reflectarray antenna geometry which satisfies certain packaging constraints, depending on the intended application. In step S902, the model can be set up by defining such parameters as the shape and positions of an equivalent subreflector and set of feed horns, the position of the two foci F1 and F2, and the two radiation directions $\theta_1$, $\theta_2$. In some embodiments, a certain compression factor may be applied in step S902 to reduce the angular separation between adjacent beams. This in turn can reduce the physical size of the DRA and consequently reduce the overall size of the antenna.

Next, in step S903 the model is used to determine the field that would be produced at the subreflector and feed horn arrangement in an equivalent bifocal antenna configured to produce a similar beam pattern. Step S903 may involve computing partial phase derivatives as a set of points via an iterative process, wherein the surfaces of the subreflector and reflector of the equivalent bifocal antenna are characterised by the partial derivatives. Then, the derivatives can be integrated to compute the phase distribution across the surface of each reflector, i.e. the subreflector and the main reflector.

In some embodiments, the bifocal antenna principle may be used to compute the phases for the subreflector and the main reflector for one or more feed horns at intermediate positions between the two defined foci F1 and F2 shown in FIG. 1. When an intermediate feed horn position is used, the resulting beam will be radiated in between the two directions $\theta_1$, $\theta_2$ that are defined as inputs for the bifocal algorithm.

Then, in step S904 the plurality of coefficients that are required to produce a similar incident field at the surface of the reflector 120, 720 are determined. As described above, in some embodiments the re-configurability of the DRA 110, 710 may be exploited so as to produce intermediate beams that would not be possible with a conventional bifocal antenna, thereby allowing continuous beam scanning over the area of interest without degrading the beams at the edges due to the position of the feeds out of the focus of the parabola.

After the plurality of coefficients have been computed using a method such as the one shown in FIG. 9, the DRA controller 111, 711 may subsequently control the plurality of radiating elements of the DRA 110, 710 according to the coefficients that were determined in step S904. In this way, the field generated at the DRA 110, 710 will produce the plurality of beams that were defined by the antenna configuration information provided in step S901.

Whilst certain embodiments of the invention have been described herein with reference to the drawings, it will be understood that many variations and modifications will be possible without departing from the scope of the invention as defined in the accompanying claims.

The invention claimed is:

1. A multibeam antenna comprising:

a direct radiating array, DRA, comprising a plurality of radiating elements;

a reflector facing the DRA so as to reflect a field generated by the DRA; and a DRA controller configured to control the plurality of radiating elements of the DRA according to a plurality of coefficients, such that the field generated at the DRA produces a plurality of beams when reflected by the reflector, wherein the DRA controller is configured to determine the plurality of coefficients by using a bifocal antenna model to determine a field that would be produced by a subreflector and feed horn arrangement in an equivalent bifocal antenna configured to produce the plurality of beams, and determining the plurality of coefficients required to produce a similar incident field at the surface of the reflector.

2. The multibeam antenna of claim 1, wherein the DRA controller is configured to receive antenna configuration information relating to the plurality of beams to be produced, and to determine the plurality of coefficients in dependence on the received antenna configuration information.

3. The multibeam antenna of claim 1, wherein the plurality of beams include one or more beams corresponding respectively to one or more intermediate focal points between a first focal point and a second focal point of the bifocal antenna model.

4. The multibeam antenna of claim 2, wherein the plurality of beams include one or more beams corresponding respectively to one or more intermediate focal points between a first focal point and a second focal point of the bifocal antenna model, and wherein the DRA controller is configured to set up the bifocal antenna computer model based on the received antenna configuration information.

5. The multibeam antenna of claim 2, wherein the DRA controller is configured to determine the plurality of coefficients by using the received antenna configuration information to retrieve the coefficients from memory arranged to store a plurality of sets of pre-calculated coefficients each associated with a different plurality of beams.

6. The multibeam antenna of claim 1, wherein the reflector comprises a passive reflectarray.

7. The multibeam antenna of claim 1, wherein the reflector comprises an active reflectarray.

8. The multibeam antenna of claim 7, wherein the active reflectarray is a flat or curved reflectarray.

9. The multibeam antenna of claim 7, comprising:

a reflectarray phase controller configured to control a plurality of reflecting elements of the reflectarray according to a plurality of reflectarray phase controls.

10. The multibeam antenna of claim 9, wherein the reflectarray controller is configured to select the plurality of reflectarray phase controls so as to cancel one or more grating lobes in the field produced by the DRA.

11. A method of controlling a multibeam antenna comprising a direct radiating array, DRA, comprising a plurality of radiating elements, and a reflector facing the DRA so as to reflect a field generated by the DRA, the method comprising:

determining a plurality of coefficients for controlling the plurality of radiating elements of the DRA, by using a bifocal antenna model to determine a field that would be produced by a subreflector and feed horn arrangement in an equivalent bifocal antenna configured to produce a plurality of beams, and determining the plurality of coefficients required to produce a similar incident field at the surface of the reflector; and controlling the plurality of radiating elements of the DRA according to the determined plurality of coefficients, such that the field generated at the DRA produces the plurality of beams when reflected by the reflector.

12. The method of claim 11, comprising:

receiving antenna configuration information relating to the plurality of beams to be produced; and determining the plurality of coefficients in dependence on the received antenna configuration information.

13. The method of claim 11, wherein the plurality of beams include one or more beams corresponding respectively to one or more intermediate focal points between a first focal point and a second focal point of the bifocal antenna model.

14. The method of claim 12, wherein the plurality of beams include one or more beams corresponding respectively to one or more intermediate focal points between a first focal point and a second focal point of the bifocal antenna model, the method comprising:

setting up the bifocal antenna computer model based on the received antenna configuration information.

15. A non-transitory computer-readable storage medium storing computer program instructions which, when executed, perform a method according to claim 11.

* * * * *